US006270449B1

(12) United States Patent
Hirayama

(10) Patent No.: US 6,270,449 B1
(45) Date of Patent: Aug. 7, 2001

(54) DEVELOPING ROLLER

(75) Inventor: Naka Hirayama, Shizuoka-ken (JP)

(73) Assignee: Nitto Kogyo Co., Ltd., Tokyo (JP)

( * ) Notice: Subject to any disclaimer, the term of this patent is extended or adjusted under 35 U.S.C. 154(b) by 0 days.

(21) Appl. No.: 09/471,401

(22) Filed: Dec. 23, 1999

(30) Foreign Application Priority Data

Dec. 24, 1998 (JP) ..... 10-367054

(51) Int. Cl.[7] ..... B25F 5/02
(52) U.S. Cl. ..... 492/54; 492/56; 492/58
(58) Field of Search ..... 492/56, 58, 54; 399/333; 428/35.8, 450, 36.91; 430/124, 99, 102

(56) References Cited

U.S. PATENT DOCUMENTS 5,895,689 * 4/1999 Gajewski ..... 492/56
5,895,711 * 4/1999 Yamaki et al. ..... 492/56
6,020,054 * 2/2000 Masuda et al. ..... 492/56
6,114,041 * 9/2000 Tan et al. ..... 492/56
6,127,041 * 10/2000 Szostek et al. ..... 428/450
6,142,922 * 11/2000 Yoshikawa ..... 492/56
6,168,867 * 1/2001 Davis et al. ..... 428/450

* cited by examiner

*Primary Examiner*—I Cuda-Rosenbaum
(74) *Attorney, Agent, or Firm*—Armstrong, Westerman, Hattori, McLeland & Naughton, LLP

(57) ABSTRACT

A developing roller has a core bar, an electrically conductive layer formed on the circumferential surface of the core bar, and a covering layer formed on the circumferential surface of the conductive layer. The covering layer includes a reaction product produced by subjecting a reaction mixture containing a polyol, an isocyanate compound and a both-terminal reactive silicone oil to a reaction condition for them, and has a dynamic friction coefficient against paper of 0.9 or more and less than 1.2.

18 Claims, 1 Drawing Sheet

DEVELOPING ROLLER

BACKGROUND OF THE INVENTION

The present invention relates to a developing roller that is used in developing devices such as a copying machine, a facsimile and a laser beam printer. The present invention relates more specifically to a developing roller particularly suitable for a developing device of a nonmagnetic one-component toner-developing mode.

Formerly, the main current of the developing mode of developing devices such as a laser beam printer was a developing mode using a magnetic two-component toner. However, from the standpoint of the protection of the earth environment and saving of resources, attention has been paid to a developing mode using a nonmagnetic one-component toner, in which toner recovery is unnecessary, a waste toner is not generated and all amounts of a toner inside a toner cartridge can be used up. Therefore, efforts have been being made to put this mode into practical use.

A developing device of this nonmagnetic one-component toner developing mode basically comprises a photosensitive drum; electrostatic latent image-forming means for forming an electrostatic latent image on the photosensitive drum; a developing roller which rotates while it contacts the photosensitive drum directly or is close thereto; a toner-supplying member comprising, e.g., a supply roller made of polyurethane sponge, for supplying a nonmagnetic one-component toner to the developing roller; and a toner-regulating member comprising, e.g., a blade made of urethane rubber or urethane resin, for regulating the toner supplied onto the developing roller into a uniform thickness. In general, the electrostatic latent image-forming means forms an electrostatic latent image on the surface of the photosensitive drum on the basis of given image information. Simultaneously, the toner-supplying the developing roller. The toner-regulating member regulates the toner supplied onto the developing roller into a uniform thickness, so as to form a uniform thin layer of the toner on the surface of the developing roller. The developing roller having, on its surface, the thin toner layer of the uniform thickness causes the toner to adhere successively onto the electrostatic latent image on the photosensitive drum at a nip portion between the roller and the photosensitive drum or at a portion near the drum. In this way, the toner development is performed.

The developing roller used in the developing device of such a nonmagnetic one-component toner developing mode is a roller which causes the toner charged positively or negatively by friction contact to adhere electrostatically to the surface of the roller. This roller is composed of an electrically conductive roller. Such an electrically conductive roller usually has a structure wherein an electrically conductive layer made of an electrically conductive material is formed on the columnar surface of an electrically conductive core (metal core) constituting the body of the roller. Hitherto, as the conductive material constituting this conductive layer, there has been used an electrically conductive rubber material in which an electrically conductive material, such as carbon black or a metal powder, for imparting electrical conductivity, is blended with a base of a rubber material such as silicone rubber, acrylonitrile/butadiene rubber, urethane rubber, or silicone-modified ethylene/propylene rubber.

However, silicone rubber and silicone-modified ethylene/propylene rubber contain a low-molecular siloxane. The siloxane is transferred to the surface, resulting in a problem that the surface of the photosensitive drum contacting the developing roller is polluted by this low-molecular siloxane. As for acrylonitrile butadiene rubber, sulfur or a sulfur derivative is used as a vulcanizing agent thereof. Thus, the surface of the photosensitive drum is also polluted by the vulcanizing agent. On the other hand, urethane rubber hardly pollutes the photosensitive drum; however, its volume resistance is largely changed by a change in environment. That is, the dependency of the resistance upon the environment is large. Thus, urethane rubber is not so practically used.

In general, the roller having a rubber layer alone has a large coefficient of dynamic friction at its surface. Thus, a large torque is required for rotating the developing roller, in view of the friction between the roller and a contact member such as the toner-regulating blade or the toner-supplying roller. Thus, a stronger motor becomes necessary. This hinders downsizing of the device, and reductions in electric power consumed and costs.

Thus, in order to solve problems of conventional rubber-based conductive layers, in particular, the problem of pollution of the surface of the photosensitive drum and the problem of driving torque of the developing roller, a covering layer has been formed on the surface of the rubber-based conductive layer. For example, the gazette of Japanese Patent No. 2504978 discloses that a covering layer comprising a reaction product (fluorine-containing urethane) of an urethane resin and a fluorine-containing compound having a functional group is formed on the surface of a rubber-based conductive layer. This covering layer blocks the above-mentioned transferring pollutant in the rubber-based conductive layer thereat. Therefore, it is possible to prevent the transferring pollutant from polluting the surface of the photosensitive drum.

However, even in developing rollers having the conventional covering layer, toner is damaged since the toner is subjected to friction between the surface of the developing roller and the toner-regulating blade or the photosensitive drum. As a result, there arises the phenomenon that the toner fixes onto the surface of the developing roller, that is, the phenomenon of filming, adversely affecting the printed images. The filming occurs also on the photosensitive drum. In this case, the filming portion appears as a missing portion in the form of a stripe or stripes in the printed image. The filming is remarkably generated in a toner seal portion, which a strong stress is applied to toner. In this case, a bad effect is produced on the sealability for the toner. At worst, problems such as leakage of the toner arise.

BRIEF SUMMARY OF THE INVENTION

Therefore, a main object of the present invention is to provide a developing roller which keeps the advantages of the conventional polyurethane covering layers and yet has excellent resistance against filming.

In order to attain the above-mentioned object, the inventor examined the relationship between the dynamic friction coefficient of the surface layer of a developing roller and the driving torque of this roller or filming. As a result, the inventor has found that some range of the dynamic friction coefficient of the developing roller prevents filming from being generated and makes the driving torque of the developing roller small. The present inventor has further made studies to find that it is effective that a siloxane component is introduced into a polyurethane covering layer covering an electrically conductive rubber layer; however, the siloxane component should be introduced within the polyurethane molecule chain such as to bridge the polyurethane molecules, not introduced as a side chain to the polyurethane molecule chain.

Thus, the present invention provides a developing roller, comprising a metal core bar, an electrically conductive layer formed on the circumferential surface of the core bar, and a covering layer formed on the circumferential surface of the conductive layer, the covering layer comprising a reaction product produced by subjecting a reaction mixture containing a polyol, an isocyanate compound and a silicone oil reactive at the both terminals (hereinafter often referred to as both-terminal reactive silicone oil) to a reaction condition for them, and having a dynamic friction coefficient against paper of 0.9 or more, but less than 1.2.

Preferably, the reaction mixture further contains a volatile silicone oil. In this case, the covering layer may be composed of a porous body, as a whole.

In the present invention, the polyol is preferably a fluorine-containing polyol.

In the present invention, the both-terminal reactive silicone oil is represented by the following general formula (1):

(1)

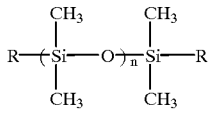

where each R represents $—C_3H_6OC_2H_4OH$, and n is an integer of about 20 or less.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out hereinafter.

DETAILED DESCRIPTION OF THE INVENTION

Figure 1:
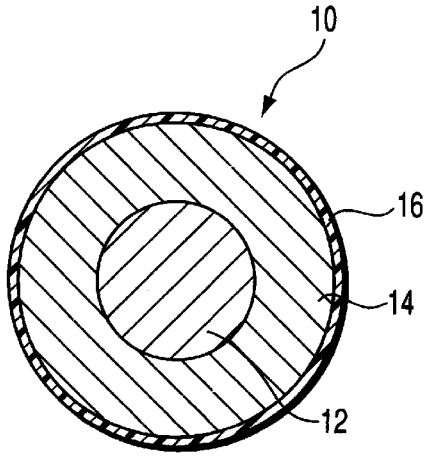
FIG. 1 is a schematic sectional view showing a structure of a developing roller according to the present invention.

Referring to FIG. 1, one embodiment of the present invention will be described in detail below.

FIG. 1 schematically shows a cross section of a developing roller according to one embodiment of the present invention.

As shown in FIG. 1, a developing roller 10 of the present invention basically has an electrically conductive, columnar roller body (core bar) 12, an electrically conductive layer 14 formed to cover substantially the whole of the circumferential surface of the core bar 12, and a covering layer 16 formed to cover substantially the whole of the circumferential surface of the conductive layer 14.

In the present invention, the core bar 12 is not especially different from conventional core bars, and may be made of a metal such as iron.

In the present invention, the conductive layer 14 is preferably made of an electrically conductive elastic polymer material in which an electrical conductivity-imparting agent such as carbon black or metal powder is added to an elastic polymer as a base.

The elastic polymer material as the base that can be used may be synthetic rubber materials such as silicone rubber, acrylonitrile-butadiene rubber, silicone-modified ethylene-propylene rubber and urethane rubber, or thermoplastic elastomers such as thermoplastic urethane resin. In the present invention, preferable examples of the base polymer material are the synthetic rubber materials. Therefore, the conductive layer 14 is preferably made of an electrically conductive rubber material. The conductivity-imparting agent is preferably blended with the base polymer material at such a ratio that the conductive layer 14 exhibits a volume resistance of $10^2$–$10^{10}$ Ω·cm. Moreover, the conductive layer 14 preferably has a JIS A hardness of 20–60°.

The developing roller 10 forms a nip portion with a photosensitive drum or a toner-regulating member. Therefore, if the compressive strain of the underlying conductive layer 14 is large, the impression of the nip remains on the developing roller to adversely affect the images formed. Accordingly, it is most preferable that the material forming the conductive layer 14 exhibits a compression set of 5% or less after the material is allowed to stand under a 25% compressive load at 70° C. for 22 hours. From the viewpoint of practical use, however, a material having a compression set of 10% or less can be used without any problems.

In the present invention, physical properties, such as hardness, volume resistance and compression set, of the developing roller as a whole are substantially determined by the conductive layer 14.

The covering layer 16 of the present invention comprises a polyurethane modified with the both-terminal reactive silicone oil, and exhibits a dynamic friction coefficient of 0.9 or more and less than 1.2 against paper at a paper-feeding speed of 50 mm/minute under a load of 14.8 g. The covering layer 16 of the present invention is made of such a silicone-modified polyurethane and further has such a dynamic friction coefficient, so that the present invention can maintain the advantages of the conventional polyurethane covering layers (the prevention of the photosensitive drum from being polluted by transferring substances) and yet suppress the generation of the filming phenomenon. Besides, the developing roller of the present invention can suppress the generation of a negative ghost that has come into a problem in the prior art.

Figure 2:
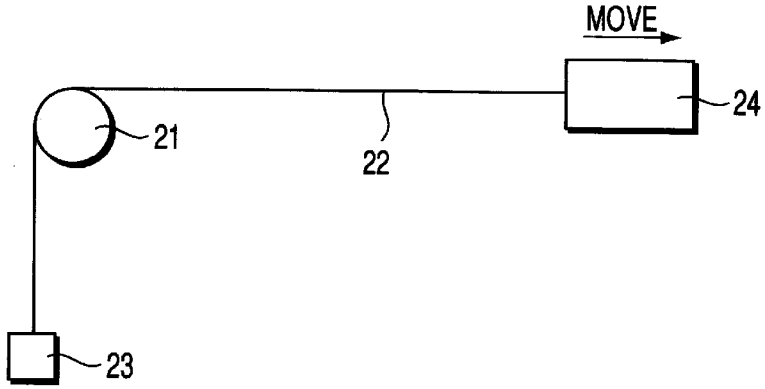
FIG. 2 is a schematic view for explaining a method for measuring the dynamic friction coefficient of the developing roller in the present invention.

In the present invention, as shown in FIG. 2, the dynamic friction coefficient of the covering layer 16 is measured by putting a copying paper sheet (L paper made by Fuji Xerox Co., Ltd.) over a developing roller 21, hanging a weight 23 of 14.8 g at the free lower end thereof, connecting a load converter 24 at the other end thereof, and moving the load converter 24 in the horizontal direction at a speed of 50 mm/minute. The measurement is performed in a room at a temperature of 24° C. and a relative humidity of 69%.

The covering layer 16 of the present invention is formed by subjecting a reaction mixture containing a polyol, an isocyanate compound and the both-terminal reactive silicone oil to a reaction condition of these three components.

The polyol that is used in the present invention is preferably liquid at room temperature (20–30° C.). Thus, various polyols may be used. The covering layer 16 needs to have electrical chargeability, and the polyol is preferably a polyol which reacts with the isocyanate compound to give a covering layer (polyurethane) having a high triboelectrical rank. Preferred examples of such a polyol include polyethylene glycol, polypropylene glycol, tetramethylene glycol and polyether polyol such as polyalkylene glycol of copolymers thereof.

As the polyol used in the present invention, however, a fluorine-containing polyol is especially preferred. The fluorine-containing polyol reacts with the isocyanate compound to produce a covering layer having a higher triboelectric rank. Moreover, the fluorine-containing polyol reduces the dependency of the resistance on the environment of the covering layer produced. As the fluorine content in the fluorine-containing polyol becomes higher, the triboelectric rank becomes higher in negativity. Preferred examples of the fluorine-containing polyol include a copolymer which is mainly made from trifluoroethylene monomer (a copolymer polyol having a trifluoroethylene monomer unit as a main component), and a copolymer which is mainly made from a tetrafluoroethylene monomer (a copolymer polyol containing a tetrafluoroethylene monomer unit as a main component). These fluorine-containing polyols are commercially available under the tradename of Zeful (a copolymer polyol containing a tetrafluoroethylene unit as a major component) from Daikin Industries, Ltd.; and under the tradename of Lumiflon (a copolymer polyol containing a trifluoromonohaloethylene monomer as a major component) from Asahi Glass Industry Co., Ltd. A fluorine-containing polyol available under the tradename of Diffensa from Dainippon Ink & Chemicals, Inc. can also be used. Such fluorine-containing polyols are made mainly from, for example, a tetrafluoroethylene monomer, and comprises hydroxymonocarboxylic ester of acrylic acid and/or glycol monoester of acrylic acid, which is copolymerized with the tetrafluoroethylene monomer, in a total amount of at least 2 moles. The above-mentioned monomer of acrylic ester gives these fluorine-containing copolymer polyols an OH component (OH of the carboxylic group in the case of the hydroxymonocarboxylic ester of acrylic acid, and OH of glycol that is not esterified in the case of the glycol monoester of acrylic acid). In the present invention, especially preferred is a copolymer polyol comprising a tetrafluoroethylene monomer as a major component.

The isocyanate compound that is preferably used in the present invention may be diisocyanates such as diphenylmethane diisocyanate (MDI), tolylene diisocyanate (TDI), hexamethylene diisocyanate (HDI), as well as burette-modified form, isocyanurate-modified form and urethane-modified form thereof. Especially preferred isocyanate compounds are HDI, burette-modified for, isocyanurate-modified form, and urethane modified form thereof. As the molecular chain of isocyanate compounds is longer, the isocyanate compounds make it possible to produce a softer polyurethane covering layer 16.

The reactive silicone oil that can be used in the present invention is a silicone oil that is reactive at its both terminals, that is, a silicone oil that has active hydrogen atoms at its both terminals. Because of the both-terminal reactivity, the reactive silicone oil can introduce its siloxane component into the polyurethane skeleton produced by the reaction of the polyol and the isocyanate compound, and/or bridge the polyurethane molecules to introduce the siloxane component into the polyurethane. The triboelectric rank of siloxane or silicone itself is positive chargeability. As the content of the siloxane or silicone is larger, the positive chargeability of the resultant silicone-modified fluorine-containing polyurethane covering layer 16 can be increased still more. That is, by changing the amount of the added reactive silicone oil, the triboelectric rank of the covering layer 16 can be controlled.

The both-terminal reactive silicone oil is a silicone oil that can react with the isocyanate compound. Examples thereof include silicone oil having an amino group (primary and/or secondary amino groups), silicone oil having a mercapto group, and silicone oil having a hydroxyl group (such as silicone oil having a carboxyl group, silicone oil having a phenolic OH group and silicone oil having an alcoholic OH group). These reactive silicone oils are commercially available as an amino-modified silicone oil, a mercapto-modified silicone oil, a carboxyl-modified silicone oil, and phenol-modified silicone oil, a carbinol-modified silicone oil, or the like. In the present invention, it is possible to use all of silicone oils having a reactive organic group at their both terminals. A silicone oil having, at its both terminals, hydrogen bonded to silicon in its silicone skeleton may also be preferably used.

Most preferably, the reactive silicon oil can be represented by the following general formula (1):

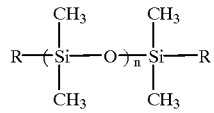

(1)

where each R represents $—C_3H_6OC_2H_4OH$ or $—C_3H_6OCH_2—C(CH_2OH)_2C_2H_5$ and n represents an integer of not less than about 20. An especially preferable reactive silicone oil is a silicone oil represented by the general formula (1) wherein each R is $—C_3H_6OC_2H_4OH$ and especially preferably n is about 10. Such a both-terminal reactive silicone oil is also commercially available.

In order to form the covering layer comprising the polyurethane into which the silicone or siloxane is introduced, most preferably a reaction mixture containing the polyol (in particular liquid fluorine-containing polyol), the isocyanate compound and the both-terminal reactive silicone oil in a suitable solvent such as butyl acetate, optionally together with an electrical conductivity-imparting material which imparts electrical conductivity to the covering layer (such as carbon black, metal powder) and/or a filler (such as silica) is applied onto a are dispersed into a suitable organic solvent onto a surface of the conductive layer 14, which is optionally coated with a primer, by such a method as spray coating so as to form a thin film, and this thin film is heated under such a condition that the polyol and the both-terminal reactive silicone oil can react with the isocyanate compound, usually at a temperature of about 100° C. to about 200° C. so as to form the covering layer 16 in situ. In this case, the thin film is hardened usually in about 20 to about 60 minutes.

The ratio of the hydroxyl group (from the polyol) equivalent plus the active hydrogen (from the both-terminal reactive silicone oil) equivalent to the isocyanate group (from the isocyanate compound) equivalent is 1:1 in the reaction mixture. Alternatively, the isocyanate compound is present in a slightly excessive amount.

If the proportion of the both-terminal reactive silicone oil is excessively larger with respect to the fluorine-containing polyol, the property of the silicone compound is intensely exhibited in the resultant covering layer itself, bringing about bad influences such as decrease in the wear resistance of the covering layer 16. In general, it is preferable that the weight ratio of the fluorine-containing polyol to the both-terminal reactive silicone oil is 1: not more than 3. If the proportion of the reactive silicone oil is changed within this range, the triboelectric rank of the covering layer can be changed from negative chargeability to positive chargeability.

It has been further found that when a volatile silicone oil is also present in the reaction mixture containing the polyol, isocyanate compound and the both-terminal reactive silicone oil during the formation of the covering layer 16 of the present invention, the resultant becomes microporous as a whole.

That is, when the reaction mixture further containing the volatile silicone oil is applied on the conductive layer 14 by spraying, etc. as noted above, the volatile silicone oil can exist, by the medium of the solvent present in the mixture, within the mixture of the polyol, the isocyanate and the both-terminal reactive silicone oil immediately after this mixture is applied on the conductive layer 14. However, when the solvent is being gradually volatilized by heating, the volatile silicone oil which is insoluble in the mixture of the polyol, the isocyanate compound and the both-terminal reactive silicone oil can no longer be dissolved in that mixture. As a result, it is considered that the volatile silicone oil is made into many microdroplets that are separated from each other in the mixture of the polyol, the isocyanate compound and the both-terminal reactive silicone oil so that a so-called sea-island structure is generated wherein the polyol, the isocyanate compound and the both-terminal reactive silicone oil constitute a continuous phase (sea) and the volatile silicone oil constitutes a discontinuous phase (islands). It is consider that while this sea-island structure from which the solvent has been volatilized is further heated, and the polyol and the both-terminal reactive silicone oil react with the isocyanate compound to produce the silicone-modified polyurethane, the microdroplets of the volatile silicone oil made into the islands are volatilized to leave micropores in the silicone-modified polyurethane so that the polyurethane covering layer 14 becomes a porous body.

The volatile silicone oil used in the present invention is a silicone oil that can be substantially completely volatilized under the temperature condition for reacting the polyol and the both-terminal reactive silicone oil with the isocyanate compound to produce the silicone-modified polyurethane covering layer 16, until the polyurethane-producing reaction (hardening of the polyol with the isocyanate compound) finishes. If the volatile silicone oil is not completely volatilized until the polyurethane-producing reaction of the polyol, the both-terminal reactive silicone oil and the isocyanate compound substantially finishes, the silicone oil may remain in the produced polyurethane layer (the conductive layer 16) to pollute the surface of the photosensitive drum. Most desirably, the volatile silicone oil has such a volatilizability that the oil is completely volatilized in 30 minutes or less when the oil is heated at 150° C. An especially preferred volatile silicone oil is a non-reactive silicone oil, which neither reacts with the polyol used, the isocyanate compound nor the both-terminal reactive silicone oil. Examples of the volatile silicone oil that can be preferably used include dimethylsilicone oil, cyclic silicone oil, and derivatives thereof such as alkyl-modified and polyether-modified forms thereof. Of these, a silicone oil having not more than 10siloxane linkage units (—SiO—) is especially preferred. In order that the silicone oil is non-reactive, each of two remaining valences of Si in each SiO bond unit is filled with an organic group having no active hydrogen, such as an alkyl, aralkyl or aryl group. In the case of a straight chain silicone oil, both terminals thereof further have the above-mentioned non-reactive organic groups.

The volatile silicone oil is contained preferably in an amount of 1 to 30% by weight of the polyol used, and more preferably in an amount of 5 to 20% by weight of the polyol used.

Among commercially available reactive silicone oils, there are oils containing the volatile silicone oil that can be used in the present invention in an amount of 10% by weight or more. When a reactive silicone oil product containing such a large amount of the volatile silicone oil is used, it may be unnecessary to add separately the volatile silicone oil for forming the porous body (that is, the contained volatile silicone oil can be used as it is), or it may be possible to make the amount of the volatile silicone oil separately added small, depending on the amount of the reactive silicone oil used. Therefore, it is necessary that the amount of the volatile silicone oil in the reactive silicone oil product is beforehand determined by an analyzing means such as gel permeation chromatography (GPC).

In the case where the covering layer 16 of the present invention is composed of the above-mentioned microporous body, preferably the layer is entirely formed of such a microporous body. In this case, preferably the pores of the covering layer 16 are so small that toner particles contacting with the covering layer cannot enter thereinto. The size of the pores is more preferably from 0.1 to 3 $\mu$m, and most preferably from 0.1 to 1 $\mu$m. It is especially preferable that the the covering layer 16 is entirely composed of the porous body having such a pore size.

The size of the respective pores of the covering layer 16 composed of the porous body may be determined by the kind of the volatile silicon oil used. All of the volatile silicon oils exemplified above can provide a pore size within the above-mentioned range.

When the covering layer 16 is composed of the above-mentioned porous body, the filming phenomenon can be still more reduced. Further, the surface of the microporous covering layer microscopically constitutes a rough surface pores, bringing about an additional advantage that mirror image force acting on toner is more alleviated than in conventional developing rollers whose outermost layer has a smooth surface. Consequently, the removal of remaining toner by means of a toner-supplying member is still more promoted so that new toner adheres more easily to the surface of the outermost layer. Accordingly, a negative ghost generated due to the toner remaining on the surface of the developing roller is more suppressed in the developing roller of the invention wherein the covering layer is formed of the porous body than in the conventional developing rollers having a smooth surface. Moreover, the porous covering layer has elasticity and is easy to deform by external force and softer than toner particles; therefore, there is produced an additional advantage that toner is not damaged at a nip portion between the roller and the photosensitive drum or the layer-thinning blade.

The porous covering layer 16 of the present invention preferably has a thickness of from 4 to 30 $\mu$m. If the thickness is over 30 $\mu$m, the surface roughness of the resultant covering layer trends to become large. If the thickness is below 4 $\mu$m, the covering layer cannot act as a barrier layer for preventing the pollutants from the conductive layer 14 as an undercoat from being transferred onto the surface, and the wear-resistance of the covering layer trends to decrease. Most preferably, the thickness of the covering layer 16 is from about 10 to about 20 $\mu$m.

As described above, the developing roller of the present invention has the conductive layer 14 on the core bar 12, and the covering layer 16 applied and formed thereon. The conductive layer 14 determines physical properties such as hardness, volume resistance and compression set, and the covering layer 16 constantly exhibits excellent surface properties as described above regardless of the physical properties of the underlying conductive layer. In the present invention, therefore, physical properties such as desired hardness, volume resistance and compressive permanent set can be obtained only by selecting the constituent material of the conductive layer 14 appropriately.

Figure 3:
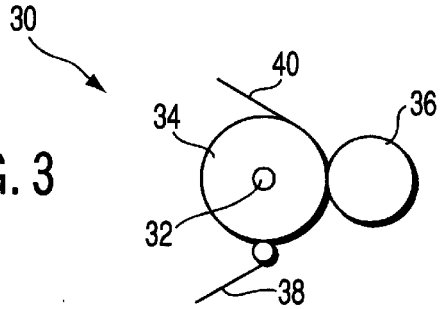
FIG. 3 is a schematic view for explaining a method for measuring the torque for the developing roller in the present invention.

It has been further found that the covering layer 16 of the present invention, in particular the covering layer 16 composed of the porous body, exhibits a substantially constant torque value (0.85–0.87 kg/cm$^2$) even if its dynamic friction coefficient changes within the range defined in the present invention. In the present invention, as schematically shown in FIG. 3, the torque value of the developing roller is measured by using a torque gauge (torque gauge TG type, made by Tohnichi Seisakusho Co., Ltd.) 32 in a measurement unit 30 having a developing roller 34, a toner-supplying roller 36 contacting with this roller 34, and a toner-regulating blade 38 made of a silicone rubber (an imaging unit for DP-560 made by Mita Industrial Co., Ltd., from which a photosensitive drum is taken off and to which the torque gauge 32 is fitted). In FIG. 3, a reference number 40 represents a film. This measurement is performed in a room at a temperature of 25° C. and a relative humidity of 70%.

The present invention will be described by way of examples hereinafter. The present invention should not however limited thereto.

EXAMPLE 1

A shaft core bar made of iron and having an outer diameter of 10 mm was coated with an electrically conductive silicone rubber having a volume resistance of $10^6$ Ω·cm and a JIS A hardness of 45° and polished to produce a silicone rubber-coated roller having an outer diameter of 16 mm.

On the other hand, 300 parts by weight of butyl acetate were added to mixture of 100 parts by weight of a fluorine-containing polyol (Zeful made by Daikin Industries. Ltd.) and 8 parts by weight of conductive carbon black (made by Cabbot Company), and the mixture was dispersed with a dispersing machine. To this dispersion were added 50 parts by weight of a carbinol-modified both-terminal reactive silicone oil (X-22-16-AS made by Shin-Etsu Chemical Co., Ltd.). The resultant mixture was stirred to prepare a main agent. This main agent was blended with urethane-modified hexamethylene diisocyanate as a hardening agent (Dulanate made by Asahi Chemical Industry Co., Ltd.) such that the ratio of the hydroxyl group equivalent in the main agent to the isocyanate group equivalent in the hardening agent was 1, so as to prepare a coating material A.

The above-mentioned rubber-coated roller was spray-coated with the thus obtained coating material A such that the covering layer had a thickness of 10 μm.

The coated material was dried in air and heated at 160° C. for 40 minutes to form a desired microporous covering layer. Thus, a developing roller was obtained.

EXAMPLE 2

A developing roller was made in the same manner as in Example 1 except that the amount of the carbinol-modified both-terminal reactive silicone oil was changed to 75 parts by weight and the amount of the conductive carbon black was adjusted to match the ratio of the conductive carbon black in the coating material A in Example 1.

EXAMPLE 3

A developing roller was made in the same manner as in Example 1 except that the amount of the carbinol-modified both-terminal reactive silicone oil was changed to 100 parts by weight and the amount of the conductive carbon black was adjusted to match the ratio of the conductive carbon black in the coating material A in Example 1.

EXAMPLE 4

A developing roller was made in the same manner as in Example 1 except that the amount of the carbinol-modified both-terminal reactive silicone oil was changed to 150 parts by weight and the amount of the conductive carbon black was adjusted to match the ratio of the conductive carbon black in the coating material A in Example 1.

EXAMPLE 5

A shaft core bar made of iron and having an outer diameter of 10 mm was coated with an electrically conductive acrylonitrile butadiene rubber having a volume resistance of $10^8$ Ω·cm and a JIS A hardness of 50° and polished to produce an acrylonitrile-butadiene rubber-coated roller having an outer diameter of 16 mm.

The coating material A of Example 1 was coated with the thus obtained acrylonitrile butadiene rubber-coated roller under the same conditions as in Example 1 to obtain a developing roller. Comparative EXAMPLE 1

The silicone rubber-coated roller made in Example 1 was used as a developing roller. Comparative EXAMPLE 2

A developing roller was made in the same manner as in Example 1, except that a coating material was used which was prepared by removing the carbinol-modified both-terminal reactive silicone oil from the coating material A of Example 1 and adjusting the other formulations as in Example 1.

Comparative EXAMPLE 3

The surface of the acrylonitrile-butadiene rubber-coated roller made in Example 5 was coated with the coating material B of Comparative Example 2 under the same condition as in Comparative Example 2 to make a developing roller.

<Measurement of torque>

A developing roller to be measured was incorporated into an imaging unit for a laser printer DP-560 type, made by Mita Industrial Co., Ltd., and was set to the body of a printer. Printing was performed on a white paper sheet to cause the toner to become affinitive with the developing roller. Next, the imaging unit was taken out from the printer body, and then its photosensitive drum was taken off. Thereafter, a torque gauge TG type made by Tohnichi Seisakusho Co., Ltd. was fitted to the developing roller at its short boss side (the side opposite to a gear). The torque gauge was rotated in a developing roller-rotating direction inside the laser printer, to record the maximum torque when the developing roller rotated, as a torque value. The measurement was performed in an atmosphere having a temperature of 25° C. and a relative humidity of 70%.

<Measurement of dynamic friction coefficient>

A developing roller to be measured was fitted to a friction gauge TR type, made by Toyo Seiki Seisaku-Sho, Ltd., and then one end of a copying paper (L paper made by Fuji Xerox Co., Ltd.) cut into a tape having a width of 20 mm was fitted to a load converter of the friction gauge TR type. The upper surface of the developing roller was rotated to fix a weight of 14.8 g to the other paper end.

Figure 4:
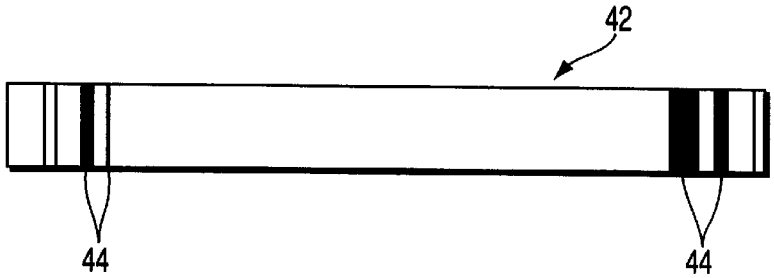
FIG. 4 is a plan view showing an example of a photosensitive drum wherein filming is remarkably generated.

The load converter was moved at a speed of 50 mm/minute in the horizontal direction. The forces at this time were recorded. Dynamic friction coefficients were obtained from the relationship between the forces and the mass of the weight. The measurement was performed in an atmosphere at a temperature of 24° C. and a relative humidity of 69%. <Generation of filming>A developing roller to be measured was installed into an imaging unit for a laser printer DP-560 type, made by Mita Industrial Co., Ltd., and was set to the body of a printer. Printing was performed on 3000 paper sheets to judge the generation of filming on the developing roller and the photosensitive drum with eyes. FIG. 4 shows an example of the photosensitive drum wherein filming is remarkably generated. A black film 44 in a band form adheres to both ends of a photosensitive drum 42 shown in FIG. 4.

The following Tables 1 and 2 show the results about the developing rollers made in Examples 1–5 and Comparative Examples 1–3.

TABLE 1

Torque values and friction coefficients

| Developing roller | Torque value ($kgf/cm^2$) | Friction coefficient |
|---|---|---|
| Example 1 | 0.85 | 0.90 |
| Example 2 | 0.85 | 1.00 |
| Example 3 | 0.85 | 1.08 |
| Example 4 | 0.87 | 1.17 |
| Example 5 | 0.85 | 0.90 |
| Comparative Example 1 | 1.10 | 1.22 |
| Comparative Example 2 | 0.85 | 0.80 |
| Comparative Example 3 | 0.85 | 0.80 |

TABLE 2

Generation of filming

| Developing roller | Generation of filming: Developing roller side | Generation of filming: Photosensitive drum side |
|---|---|---|
| Example 1 | No | No |
| Example 5 | No | No |
| Comparative Example 2 | Yes | Yes |
| Comparative Example 3 | Yes | Yes |

As described above, according to the present invention, there can be provided a developing roller making it possible to suppress the filming phenomenon and be driven with a low torque, by forming, as an outermost layer of this roller, a silicone-modified polyurethane covering layer having a given dynamic friction coefficient.

Additional advantages and modifications will readily occur to those skilled in the art. Therefore, the invention in its broader aspects is not limited to the specific details and representative embodiments shown and described herein. Accordingly, various modifications may be made without departing from the spirit or scope of the general inventive concept as defined by the appended claims and their equivalents.

What is claimed is:

1. A developing roller comprising a core bar, an electrically conductive layer formed on the circumferential surface of the core bar, and a covering layer formed on the circumferential surface of the conductive layer, said covering layer comprising a reaction product produced by subjecting a reaction mixture containing a polyol, an isocyanate compound and a both-terminal reactive silicone oil to a reaction condition for them, and having a dynamic friction coefficient against paper of 0.9 or more and less than 1.2.

2. The developing roller according to claim 1, wherein the conductive layer is made of an electrically conductive rubber material.

3. The developing roller according to claim 1, wherein the poy is a fluorine-containing poly.

4. The developing roller according to claim 1, wherein the polyol is a fluorine-containing polyol which comprises a tetrafluoroethylene monomer.

5. The developing roller according to claim 1, wherein the both-terminal reactive silicone oil is represented by the following general formula (1):

(1)

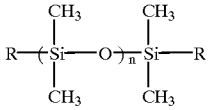

where each R represents $—C_3H_6OC_2H_4OH$, and n is an integer of about 20 or less.

6. The developing roller according to claim 1, wherein the polyol and the isocyanate compound are present in an amount sufficient that they are reacted to produce a polyurethane.

7. The developing roller according to claim 1, wherein the both-terminal reactive silicone oil is present in an amount three times or less than the weight of the polyol.

8. The developing roller according to claim 1, wherein the reaction condition includes a reaction temperature of about 100 to about 200° C.

9. The developing roller according to claim 1, wherein the reaction mixture further comprises a volatile silicone oil.

10. The developing roller according to claim 9, wherein the whole of the covering layer is composed of a porous body.

11. The developing roller according to claim 9, wherein the conductive layer is made of an electrically conductive rubber material.

12. The developing roller according to claim 9, wherein the polyol is a fluorine-containing polyol.

13. The developing roller according to claim 9, wherein the fluorine-containing polyol comprises a tetrafluoroethylene monomer unit.

14. The developing roller according to claim 9, wherein the both-terminal reactive silicone oil is represented by the following general formula (1):

(1)

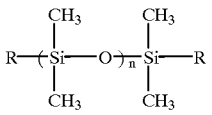

where each R represents $—C_3H_6OC_2H_4OH$, and n is an integer of about 20 or less.

15. The developing roller according to claim 9, wherein the polyol and the isocyanate compound are present in an amount sufficient that they are reacted to produce a polyurethane.

16. The developing roller according to claim 9, wherein the both-terminal reactive silicone oil is present in an amount three times or less than the weight of the polyol.

17. The developing roller according to claim 9, wherein the volatile silicone oil is present in an amount of 1–30% by weight of the polyol.

18. The developing roller according to claim 9, wherein the reaction condition includes a reaction temperature of about 100 to about 200° C.

* * * * *